US011788703B2

(12) United States Patent
Mitterlehner et al.

(10) Patent No.: US 11,788,703 B2
(45) Date of Patent: Oct. 17, 2023

(54) ILLUMINATION DEVICE OF A MOTOR VEHICLE HEADLAMP

(71) Applicant: ZKW Group GmbH, Wieselburg (AT)

(72) Inventors: Stefan Mitterlehner, Mank (AT); Günter Karlinger, Bergland (AT)

(73) Assignee: ZKW Group GmbH, Wieselburg (AT)

( * ) Notice: Subject to any disclaimer, the term of this patent is extended or adjusted under 35 U.S.C. 154(b) by 59 days.

(21) Appl. No.: 17/616,321

(22) PCT Filed: Jun. 8, 2020

(86) PCT No.: PCT/EP2020/065793
§ 371 (c)(1),
(2) Date: Dec. 3, 2021

(87) PCT Pub. No.: WO2020/259993
PCT Pub. Date: Dec. 30, 2020

(65) Prior Publication Data

US 2022/0325863 A1 Oct. 13, 2022

(30) Foreign Application Priority Data

Jun. 27, 2019 (EP) ..... 19182830

(51) Int. Cl.
*F21S 41/275* (2018.01)
*F21S 41/29* (2018.01)
*F21S 41/47* (2018.01)
*F21S 41/16* (2018.01)
(Continued)

(52) U.S. Cl.
CPC ..... *F21S 41/275* (2018.01); *F21S 41/141* (2018.01); *F21S 41/16* (2018.01); *F21S 41/295* (2018.01); *F21S 41/47* (2018.01); *F21Y 2115/10* (2016.08)

(58) Field of Classification Search
CPC ..... F21S 41/141–143; F21S 41/16; F21S 41/265–295; F21S 41/47; F21S 41/675; F21Y 2115/10
See application file for complete search history.

(56) References Cited

U.S. PATENT DOCUMENTS 8,733,957 B2 * 5/2014 Takahashi ..... F21S 41/173 362/244
9,329,379 B2 * 5/2016 Jørgensen ..... F21V 5/04
(Continued)

FOREIGN PATENT DOCUMENTS

FR 3056689 A1 3/2018
FR 3056698 A1 3/2018
JP 2014127298 A 7/2014

OTHER PUBLICATIONS

International Search Report for PCT/EP2020/065793, dated Aug. 3, 2020 (14 pages).
Search Report for European Patent Application No. 19182830.0 dated Aug. 2, 2019 (8 pages).

*Primary Examiner* — Jason M Han
(74) *Attorney, Agent, or Firm* — Eversheds Sutherland (US) LLP

(57) ABSTRACT

Lighting device of a motor vehicle headlamp, comprising a lens (1, 10) and at least one light source (2), wherein a lighting pattern (LI) can be generated by the at least one light source (2), wherein the lighting pattern (LI) generated by the light source (2) can be projected in front of the lighting device in the form of a light distribution by means of the lens (1, 10), wherein the lens (1, 10) has at least one projection optics (3, 30, 31) and one projection optics holder (4, 40), wherein at least one receiving means (5, 50, 51) is designed in the projection optics holder (4, 40), wherein the at least one receiving means (5, 50, 51) corresponds to the at least one projection optics (3, 30, 31), the at least one projection optics (3, 30, 31) is accommodated in the at least one
(Continued)

receiving means (5, 50, 51), wherein a reference point system (6, 60, 61) is defined in the at least one receiving means (5, 50, 51) for determining a position of the projection optics (3, 30, 31) accommodated in this receiving means (5, 50, 51) in such a way that the lighting pattern (LI) is essentially located in a focal plane of the lens (1, 10), wherein reference points (6-1 to 6-6, 60-1 to 60-16, 61-1 to 61-10) of the reference point system (6, 60, 61) are arranged according to the 3-2-1 rule, wherein the at least one receiving means (5, 50, 51) is closed by means of a closing element (7, 70) in such a way that the at least one projection optics (3, 30, 31) is fixed and held in the at least one receiving means (5, 50, 51) in the position determined by the reference point system (6, 60, 61).

19 Claims, 5 Drawing Sheets

(51) Int. Cl.
*F21S 41/141* (2018.01)
*F21Y 115/10* (2016.01)

(56) References Cited

U.S. PATENT DOCUMENTS

| | | | | |
|---|---|---|---|---|
| 2014/0321145 | A1 | 10/2014 | Anzai | |
| 2016/0097504 | A1 | 4/2016 | Abe | |
| 2019/0204528 | A1 | 7/2019 | Oshima et al. | |
| 2020/0208800 | A1* | 7/2020 | Abe | F21S 45/48 |

* cited by examiner

ILLUMINATION DEVICE OF A MOTOR VEHICLE HEADLAMP

The invention relates to a lighting device of a motor vehicle headlight, in particular a lighting device that functions according to a projection principle. The lighting device comprises at least one light source and a lens for projecting a lighting pattern producible by means of this at least one light source in the form of a light distribution in front of the lighting device. When the lighting device is installed in a motor vehicle headlight, the activated lighting device forms the light distribution in front of the motor vehicle headlight or in front of a motor vehicle if the motor vehicle headlamp is already installed in the motor vehicle. Preferably, the at least one light source comprises a surface on which it can produce the lighting pattern and, when it is switched on, generates this lighting pattern on the surface. In particular, the at least one light source can generate the lighting pattern on a side of the surface facing the lens. The lens comprises at least one projection optics and one projection optics holder, wherein at least one receiving means is designed in the projection optics holder, wherein the at least one receiving means corresponds to at least one projection optics and the at least one projection optics is accommodated in the at least one receiving means.

In addition, the invention relates to a motor vehicle headlight with at least one such lighting device.

The at least one projection optics can be a lens, for example a biconcave, biconvex, flat-concave, flat-convex lens or a lens system of such lenses. In the context of the present invention, the term "lens" is understood to mean a diffusing optical system that generates a real optical representation (light distribution in front of the lighting device) of an object (lighting pattern). The simplest lens can include a single lens element. It is understood that when the light source is not switched on, the lens generates an image of a switched-off light source, preferably of the surface on which the light source can generate the aforementioned lighting pattern.

Lighting devices of the aforementioned type are known from the prior art, see for example AT 517126 B1, DE 102012213842 A1.

In the lighting devices known from the prior art, complex positioning devices are used for the exact positioning of the lens or of the projection optics in the lens. This results in a long tolerance chain, which leads to high processing costs during manufacturing. The positioning device known from AT 517126 B1 is furthermore designed only for rotationally symmetrical lenses.

It is therefore an object of the present invention to create a lighting device which can be adjusted without complex positioning devices, wherein the lens of the lighting device is not limited to containing rotationally symmetrical lenses, and in which lighting device the tolerance chain is shortened, in particular in the lens.

According to the invention, this object is achieved in that a reference point system is defined in the at least one receiving means for determining a position of the projection optics accommodated in this receiving means in such a way that the lighting pattern is essentially located in a focal plane of the lens, wherein reference points of the reference point system are arranged according to the 3-2-1 rule, wherein the at least one receiving means is closed by means of a closing element in such a manner that the at least one projection optics is fixed in the at least one receiving means and held in the position determined by the reference point system.

In the context of the present invention, the term "lighting pattern essentially located in a focal plane of the lens" is understood to mean that lighting pattern which is located in a plane which is arranged at least parallel to the focal plane and preferably coincides with the focal plane. Small inaccuracies of positioning considered acceptable in the subject field, in front of or behind the focal plane, are permitted, especially if a certain blurring of light-dark transitions in the light distribution is to be achieved.

In the context of the present invention, the term "3-2-1 rule" is understood to mean a rule known from the field of tolerance management.

The aforementioned closing element may be designed correspondingly; it may, for example, have a corresponding shape to close the corresponding receiving means. The closing element may, for example, be designed as one of the projection optics that closes the corresponding receiving means—on the inside relative to the projection optics holder. However, the closing element can also be designed as a fastening clip, which encloses the projection optics holder at an open end, for example in the manner of a frame, and closes the corresponding receiving means—on the outside relative to the projection optics holder (see drawings).

The closing element can also prevent the projection optics from falling out of the receiving means. However, a clearance of the at least one projection optics fixed and held in the receiving means corresponding to this projection optics is not excluded. For example, this clearance can simplify inserting the projection optics into the receiving means and facilitate mounting the projection optics in the projection optics holder.

In a preferred embodiment, the projection optics holder may be designed as a single piece. In a particularly advantageous embodiment, the projection optics holder may be made of magnesium diecast. However, it is also conceivable that the projection optics holder is designed as a plastic injection-moulded part. In addition, it is conceivable that the projection optics holder is produced by thixomoulding or thixoforming. The choice of the manufacturing process for the projection optics holder depends on how high the accuracy requirements are or how low the tolerance fluctuations are permitted to be in the production. Plastic injection moulding is a very inexpensive method. Die-casting methods are more expensive than plastic injection moulding but allow for smaller tolerances. Thixomoulding is more expensive than die casting but allows for even smaller tolerances than die casting. In addition, overmilling would be possible as a separate method step. However, overmilling is very expensive, but allows for a flexible adjustment of a predefined target dimension.

It may be expedient if the projection optics holder has a handling area that protrudes from opposite sides of the projection optics holder. The handling area may be provided to enable simple, preferably automatic, handling or simple gripping of the projection optics holder. For this purpose, the handling area may, for example, have tabs or tab-shaped elements extending laterally from the projection optics holder. The handling area can, e.g., be gripped (automatically) by an industrial robot that allows a precise longitudinal adjustment in the axial direction or in the direction of the optical axis of the lighting device. A lighting device having a lens designed in this manner makes it possible to improve the quality of the optical representation in a particularly easy manner. In particular, the image sharpness can be adjusted more precisely, and imaging errors can be at least partially compensated for, which errors are caused by lens shape deviations, lens thickness tolerances or the like.

This can be particularly advantageous for those lighting devices that are used to generate logo projections and thus require a high image sharpness.

In a particularly preferred embodiment, the lens may comprise at least two projection optics and at least two receiving means are designed in the projection optics holder, wherein each receiving means corresponds to a projection optics and different receiving means correspond to different projection optics, wherein each projection optics is accommodated in a receiving means corresponding to this projection optics and different projection optics are accommodated in different receiving means. A reference point system is defined in each receiving means for determining the position of the projection optics accommodated in this receiving means. Preferably, different reference point systems are defined in different receiving means. As already described, the reference points of each reference point system are arranged according to the 3-2-1 rule, wherein the reference points of the different reference point systems are designed in such a way that all specified positions of the projection optics are coordinated with each other in such a way that optical axes of the different projection optics coincide and that the lighting pattern is located in the focal plane of the lens.

It can be advantageous if the receiving means are of different sizes. Each receiving means may have a constant size (neither tapering nor widening).

In addition, it may be advantageous if the size of the receiving means gradually decreases toward the at least one light source, for example. For example, a receiving means located closest to the at least one light source may be the smallest.

Furthermore, it is advantageous if each receiving means is closed by means of a closing element, wherein at least one of the closing elements is designed as one of the at least two projection optics. The different projection optics and, consequently, the different receiving means, can be of different sizes. For example, one of the projection optics may consist of two or more partial lenses, which, for example, could be of different sizes, such that the corresponding receiving means consist of two or more partial receiving means, wherein each of the partial receiving means is designed for accommodating a corresponding partial lens. In addition, further reference points may be provided between the partial lenses, which reference the partial lenses to each other, for example in the direction of the optical axis.

Further lighting advantages arise if the at least two projection optics are designed in such a way that the lens has an apochromatic effect. This makes it possible to reduce a colour fringe around a cut-off line in a low beam distribution or to reduce lateral chromatic aberrations, for example.

Further advantages arise if the reference points of the reference point system are arranged according to the area principle or translation-rotation-constraint principle of the 3-2-1 rule.

It is also advantageous if the at least one receiving means has a bottom portion and at least three of the reference points are designed as referencing elements, wherein the at least three referencing elements are arranged between the receiving means bottom and the at least one projection optics, are accommodated in the at least one receiving means, make contact with both the receiving means bottom and the projection optics, and define a primary plane of the reference point system, which is preferably arranged essentially parallel to the receiving means bottom. In the case of multiple receiving means, this preferably applies to each receiving means. The receiving means bottom may be (at least partially) formed by a projection optics or a bottom of the projection optics holder. For example, the at least one projection optics can rest on the referencing elements. Furthermore, the referencing elements may be designed on the at least one projection optics, on one of the partial lenses or on the projection optics holder. In the case of multiple projection optics, the corresponding primary planes are preferably positioned parallel to each other.

In the context of the present invention, the term "bottom of the projection optics holder" is understood to mean a surface arranged perpendicular to the optical axis opposite an opening of the projection optics holder. Therein, the opening of the projection optics holder is understood to be that opening through which the projection optics is/are inserted into the projection optics holder. Thus, the term "receiving means bottom" is understood to mean a surface that is arranged perpendicular to the optical axis.

In addition, it may be advantageous if four referencing elements are provided in the at least one receiving means (and all four define the same primary plane). The fourth referencing element helps prevent, for example, a tilting of the projection optics in the receiving means. In the case of multiple receiving means, it may be expedient if four referencing elements are arranged in each receiving means.

In a particularly advantageous embodiment, the referencing elements may be designed as protrusions, preferably as ridges, in particular as convex ridges, extending in the direction of the optical axis. For example, the referencing elements may be designed as a hemisphere which is flattened at the top. The aforementioned reference or primary plane can be defined by the ends of the referencing elements.

Particular advantages may arise if the referencing elements are designed on the projection optics holder and/or on the at least one projection optics, preferably such that they form a monolithic structure with the projection optics holder and/or with the at least one projection optics. It can be advantageous if one or more projection optics (or partial lenses) have six, eight or more referencing elements. It is particularly advantageous if the referencing elements are designed on the projection optics, namely on the optically ineffective surfaces of the projection optics.

In addition, it can be advantageous if the referencing elements are designed as spacers.

Further design advantages may arise if the projection optics holder and/or the at least one projection optics have/has counter elements corresponding to the referencing elements. The counter-elements may be designed, for example, as indentations, recesses, holes (blind or through holes) corresponding to the protrusions or the spacers, with which the protrusions or the spacers can engage at least partially.

It may be expedient if the at least one receiving means has a side wall, for example adjacent to the receiving means bottom, wherein at least two more of the reference points—those which are not designed as referencing elements—are designed as centring elements or are determined by centring elements. The side wall does not have to be designed in a single piece. For example, the side wall of the receiving means may be formed by a side wall of the projection optics holder or partly by a side wall of the projection optics holder and partly by the closing element.

It may be advantageous if the at least two centring elements are arranged between an interior circumference of the side wall and the at least one projection optics accommodated in the at least one receiving means, touch both the side wall and the projection optics and restrict a movement of the at least one projection optics along the primary plane. It should be noted that, in an assembled state of the lens, not all projection optics have to make contact with the corresponding centring elements. A certain amount of clearance between the projection optics and the centring elements is therefore permissible. If necessary, however, this clearance can be reduced and even completely eliminated by means of spring parts (elastic elements), for example.

It may be useful if the centring elements are designed on the interior circumference of the side wall of the projection optics holder and preferably form a monolithic structure with the projection optics holder.

In a particularly favourable embodiment, the centring elements may be designed as centring ridges extending in the direction of the optical axis, preferably flattened at the top. The longitudinal direction of these ridges may coincide with the direction of the optical axis. In addition, the centring ridges can protrude from the interior of the projection optics holder toward the centre of the lens, preferably perpendicular to the optical axis.

The centring elements can also be designed as centring ridges which have a triangular shape in a sectional view which extends perpendicular to the optical axis, which are connected by means of a bar and which form a V-shape, into which a rotationally symmetrical projection optics can be inserted particularly well. This means that such bars can form a receiving means which is V-shaped (on its lower side), which is particularly suitable for rotationally symmetrical lenses.

In addition, it may be expedient if the at least one projection optics has counter-elements corresponding to the centring elements, for example recesses.

In addition, the at least one receiving means may have a receiving opening, wherein the closing element closing the at least one receiving means is designed such, and is arranged in the receiving opening such, that the light emitted from the at least one projection optics accommodated in the at least one receiving means can pass through the closing element. In the case of multiple receiving means, this preferably applies to each receiving means and each closing element. For this purpose, the closing element may, for example, have an opening.

The closing element can be designed as a fastening clip.

It may be useful if the fastening clip is attached to the projection optics holder in such a way that it pushes the at least one projection optics accommodated in the projection optics holder at least in a direction opposite to the direction of an optical axis of the lens. Preferably, the at least one projection optics is thus fixed in the projection optics holder in such a way that it can no longer move along the optical axis. In the case of multiple projection optics, all projection optics can be fixed by the fastening clip in the direction of the optical axis. This means that the fastening clip clamps the projection optics in the projection optics holder, such that a clearance between the optics in the direction of the optical axis is no longer possible.

In a preferred embodiment, a receiving opening may be designed at that end of the projection optics holder which is located the farthest from the at least one light source. In this case, the fastening clip may be attached to this end of the projection optics holder. For example, the fastening clip may have locking openings corresponding to the locking catches designed at this end of the projection optics holder, such that the fastening clip can lock onto the projection optics holder. The locking catches may be designed on an exterior circumference of the end of the projection optics holder, for example. The fastening clip can surround the (open) end of the projection optics holder in the manner of a frame, for example. In the case of multiple projection optics, it may be expedient if the fastening clip pushes all projection optics toward the light source, i.e., in the direction of the light source or in the opposite direction to the optical axis. For this purpose, the fastening clip may, for example, have two protrusions.

In this case, it may be advantageous if the fastening clip has at least two protrusions in the form of ridges on its side facing the at least one light source, which ridges preferably protrude from the fastening clip in the direction opposite to the direction of the optical axis. This increases the accuracy of pressing the projection optics into the projection optics holder. The number of ridges—at least two—has the advantage that the projection optics which are in contact with the ridges are less susceptible to tilting.

In addition, the at least one light source may comprise a spatial light modulator, in particular a DMD chip, and may be able to generate the lighting pattern on the spatial light modulator. The mirror array of the spatial light modulator may be located in a focal plane of the lens. Thus, the surface on which the lighting pattern can be formed may be designed as a mirror array.

However, the surface can also be designed as a light-emitting surface of one or more LEDs or a light-converting plate, which can be illuminated with a laser light source.

The at least one light source may comprise semiconductor-based elements, such as laser diodes and/or LEDs.

In a preferred embodiment, it may be advantageous if the lens furthermore comprises at least one, preferably two-dimensional, in particular flat aperture device. Therein, the aperture device can extend perpendicular to the optical axis.

It may be useful if the at least one aperture device has an aperture edge that is continuous within itself.

It may be advantageous if the at least one aperture device is designed as a receiving means bottom.

Further advantages may arise if the at least one aperture device is formed as a separate plate, which is preferably arranged perpendicular to the optical axis of the lens.

The at least one aperture device can be used to further improve the quality of the light distribution. If multiple aperture devices are provided, they can be used to correct different optical errors.

In one embodiment, it may be expedient if the separate plate has through-openings. The through-openings may, for example, be designed such that they match the referencing elements designed as ridges. When assembled, the ridges can be accommodated in the through-openings. This makes it possible to specify the position of the plate in the lens relative to the projection optics.

Further advantages may arise if the at least one aperture device has at least one (preferably two) elastic tab(s). As a result, the projection optics(s) can be better clamped in the projection optics holder. Two elastic tabs reduce tilting. In general, reducing tilting reduces decentration errors.

For example, two tabs may be arranged on the side of the aperture edge which is continuous within itself.

A particularly advantageous embodiment results if the at least one projection optics consists of two partial lenses and preferably has an achromatic effect. This can, for example, reduce longitudinal chromatic aberrations. At least three further referencing elements may be provided between the partial lenses. This can be a so-called achromat (see, e.g., DE 10 2010 046 626 84 and in particular paragraphs [0009] to [0013]). One of the two partial lenses may be, for example, biconvex or plano-convex, wherein the other one may be designed in a biconcave or plano-concave shape.

Furthermore, it may be advantageous if the lens comprises elastic elements that are set up to clamp the at least one projection optics in the at least one receiving means. The elastic elements may, for example, be arranged in the projection optics holder and in particular may be integrally designed with the same.

In a preferred embodiment, the lighting device may be designed as a light module. This means that the lighting device forms an assembly when mounted and does not consist of structurally separated elements or subunits.

In addition, it should be clear that direction-related terms such as "horizontal", "vertical", "top", "bottom", etc. are to be understood in connection with the present invention to have a relative meaning and refer either to the aforementioned appropriate installation position of the subject matter of the invention in a motor vehicle or to a customary orientation of a radiated light distribution in the lighting pattern or in the space to be travelled through.

The invention and other advantages are explained in more detail below on the basis of exemplary embodiments, which are illustrated in the drawings. In these, FIG. 1*a* shows a lighting device with a projection optics in perspective view;

FIG. 1*b* shows a lighting device from FIG. 1*a* in perspective view without closing element;

FIG. 1*c* shows a lighting device from FIG. 1*a* in perspective view without closing element and without projection optics;

Figure 1A:
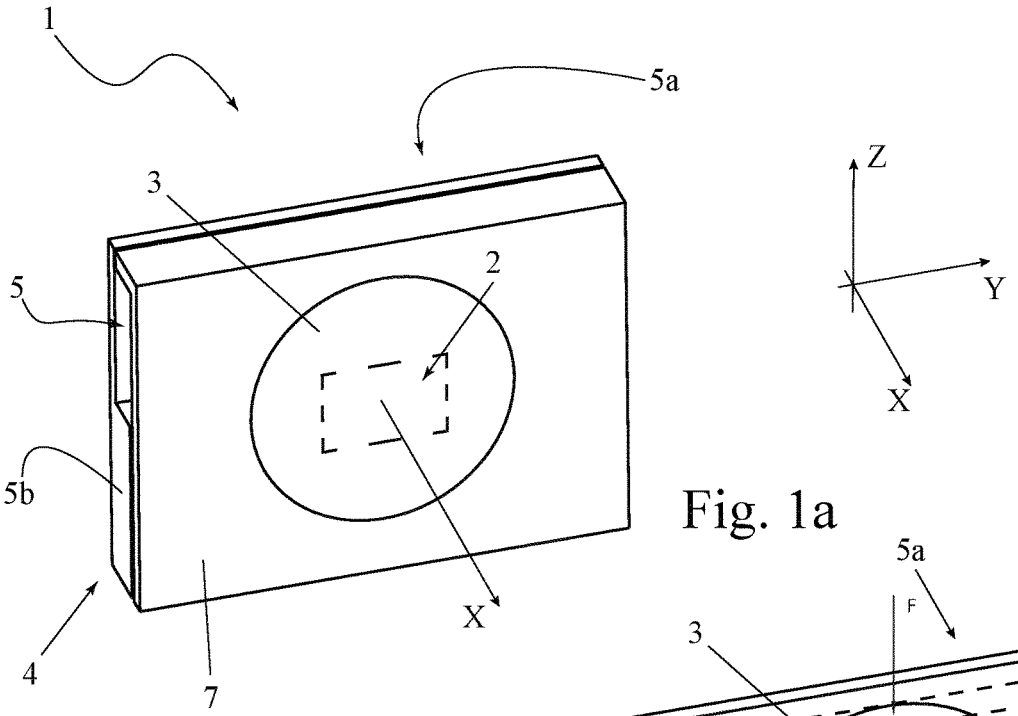
Figure 1B:
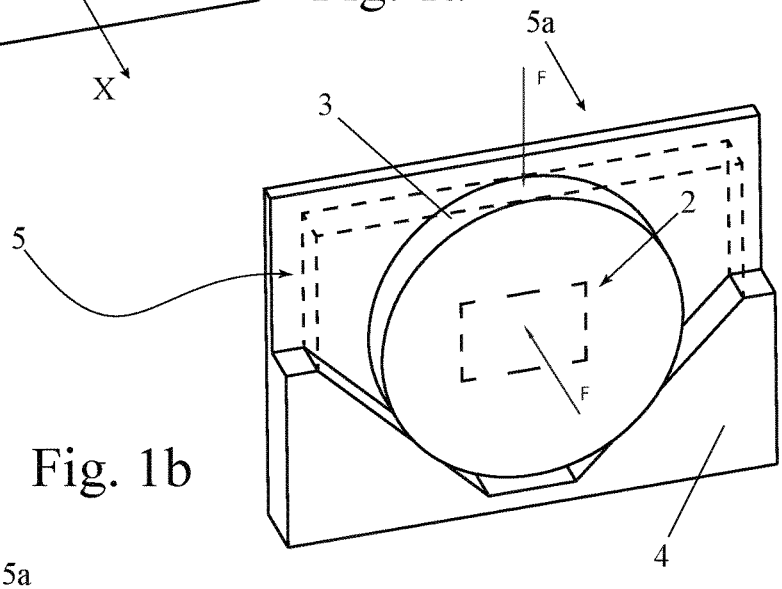
Figure 1C:
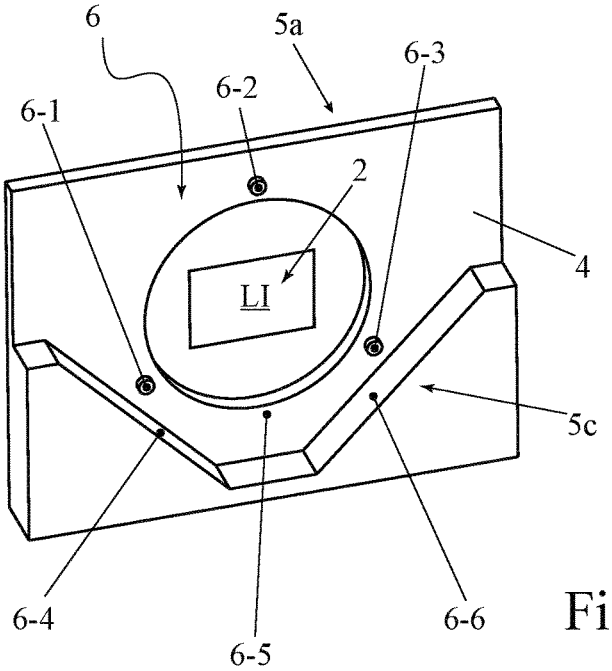

First, reference is made to FIG. 1*a* to 1*c*. These show a lighting device designed as a light module for a motor vehicle headlight with a lens 1 and a light source 2. The light source 2 can generate a lighting pattern LI. As can be seen in FIG. 1*a* to 1*c*, the light source 2 may comprise a surface on which it can generate the lighting pattern LI. In particular, the at least one light source can generate the lighting pattern LI on a side of the surface facing the lens 1. This surface may be designed, for example, as a surface of a micromirror array of a spatial light modulator, such as a DMD chip, as a surface of a light-converting means (phosphorus), which can convert light from a laser diode source into essentially white light, as a light-emitting layer of an LED, or as a light-emitting surface of an attachment optics (made of silicone), for example a TIR lens. When the lighting device is switched on, the light source 2 thus generates the lighting pattern LI, which is projected by the lens 1 in front of the lighting device in the form of a light distribution. The lens 1 has at least one projection optics 3 and one projection optics holder 4. A receiving means 5 corresponding to the projection optics 3 is designed in the projection optics holder 4. The projection optics 3 is accommodated in the at least one receiving means 5. The projection optics 3 may be, for example, a lens, for example a rotationally symmetrical lens (see FIG. 1*a* to 1*c*). A reference point system 6 is defined in the at least one receiving means 5, i.e., a system of reference points 6-1 to 6-6, which specify a position of the projection optics 3 accommodated in the receiving means 5. The position is specified in such a way that the lighting pattern is essentially located in a focal plane of the lens 1. Therein, the term "essentially located in a focal plane" is taken to mean that the lighting pattern is located at least in a plane which is arranged parallel to the focal plane and preferably coincides with the focal plane, wherein this phrase also covers small, unavoidable inaccuracies commonly accepted in the art with regards to the positioning of the lighting pattern in front of or behind the focal plane.

The reference points 6-1 to 6-6 of the reference point system are arranged according to the 3-2-1 rule. This refers to the 3-2-1 rule known from the field of tolerance management, which is less commonly also referred to as the 3-2-1 principle.

In order to fix and hold the projection optics 3 in the position specified by the reference point system 6 in the receiving means 5, a closing element 7 is provided. Preferably, the closing element 7 prevents the projection optics 3 from falling out of the receiving means 5. The closing element 7 closes the projection optics 3 in the receiving means 5 in such a way that it pushes onto the projection optics 3 from preferably two directions (shown in FIG. 1*b* with arrows F), in which the projection optics 3 located in the above position can "fall out" of the receiving means 5, and thus fixes and holds the projection optics 3 in the position specified by the reference point system 6. Nevertheless, a certain clearance in the YZ plane, which is considered tolerable in the art, may be permissible.

The projection optics holder 4 can be designed as a single piece. For example, it can be made from magnesium diecast. However, a plastic injection-moulded part or thixomoulding is also conceivable. This is decided according to the required accuracy requirements (tolerance fluctuations in production) required by the optical design. For very high requirements, post-processing, e.g., milling of the reference surfaces, is also conceivable.

Figure 2:
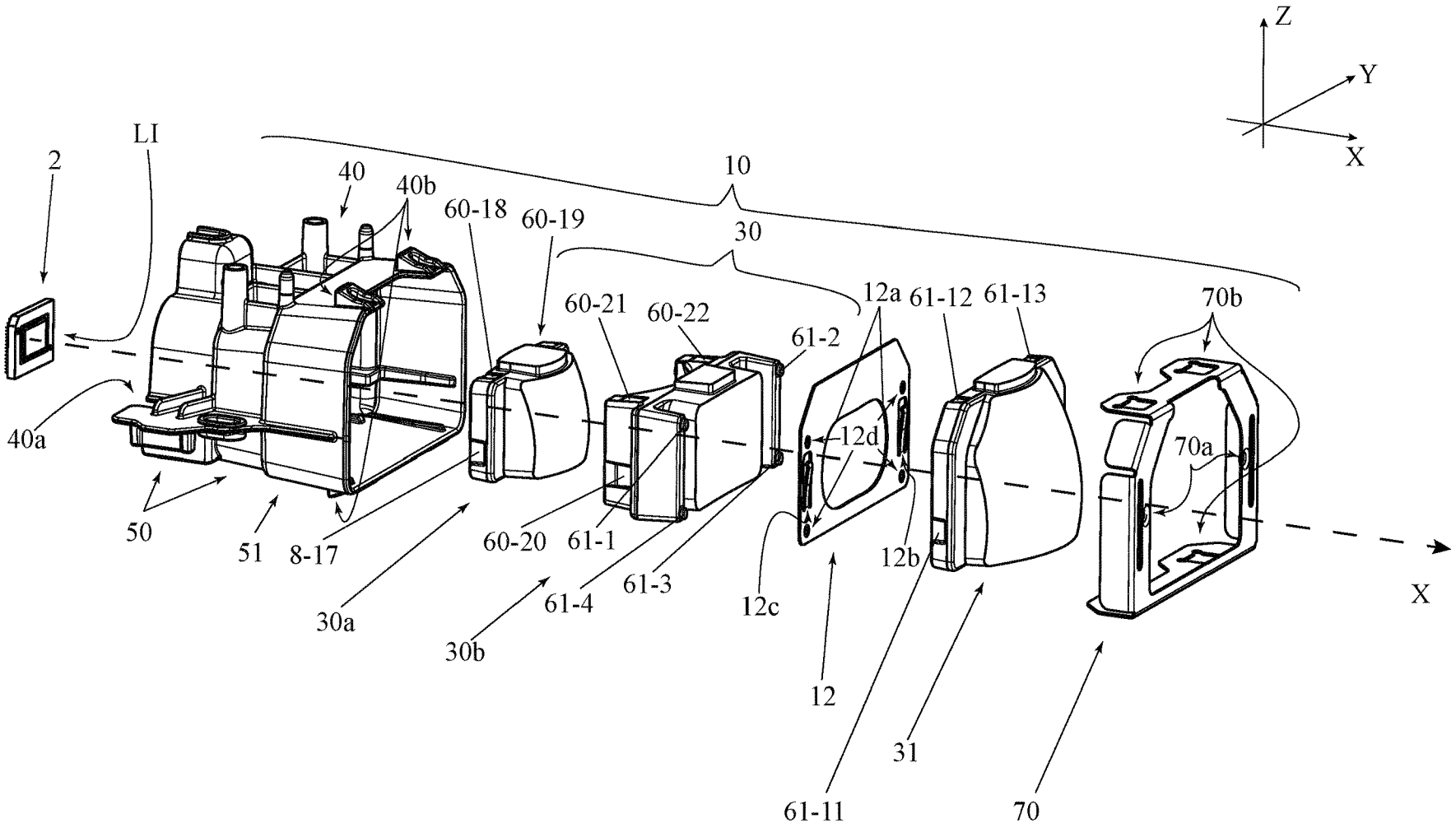
FIG. 2 shows a lighting device with three lens elements in an exploded view.

FIG. 2 is an exploded view of a lighting device with a light source 2 and a lens 10, wherein more than one projection optics is accommodated in the lens 10. Specifically, FIG. 2 shows a lens 10 with a projection optics holder 40, in which two projection optics 30, 31 are accommodated, wherein one of the projection optics 30, 31—the projection optics 30—consists of two partial lenses 30*a* and 30*b*. The projection optics 30, 31 are not rotationally symmetrical. A projection optics 30 consisting of two partial lenses 30*a* and 30*b* can reduce achromatic errors, such as, e.g., longitudinal chromatic aberrations.

The projection optics holder 40 has a handling area 40*a*. For example, the handling area 40*a* is arranged at the end of the projection optics holder 40 closest to the light source 2. The handling area 40*a* may also be arranged in another place along the longitudinal direction X of the projection optics holder 40. The handling area 40*a* may, as already described, serve to facilitate automated gripping of the lens 10 and may include laterally protruding tabs with bars protruding upwards.

Two receiving means 50, 51 are designed in the projection optics holder 40 for accommodating the projection optics 30, 31. Each receiving means 50, 51 corresponds to a projection optics 30, 31 and the different receiving means 50, 51 correspond to different projection optics 30, 31. Therein, each projection optics 30, 31 is accommodated in one of these receiving means 50, 51 corresponding to the projection optics 30, 31. Different projection optics 30, 31 are accommodated in different receiving means 50, 51.

A reference point system 60, 61 is defined in each receiving means 50, 51 for specifying the position of the projection optics 30, 31 accommodated in the respective receiving means 50, 51. As already described above, the reference points 60-1 to 60-16, 61-1 to 61-10 of each reference point system 60, 61 are arranged according to the 3-2-1 rule. Therein, the reference points 60-1 to 60-16, 61-1 to 61-10 of the different reference point systems 60, 61 are designed in such a way that all specified positions of the projection optics 30, 31 are coordinated with each other in such a way that optical axes of the different projection optics 30, 31 coincide and that the lighting pattern LI is essentially located in the focal plane of the lens 10. "Essentially located in the focal plane" means that the lighting pattern LI is located at least in a plane that is arranged parallel to the focal plane and preferably coincides with the focal plane. Small inaccuracies in the positioning, in front of or behind the focal plane, are of course permissible.

Each receiving means 50, 51 is closed by means of a closing element. As indicated in FIG. 2 (see also FIG. 4), one of the closing elements, namely the closing element which closes the first projection optics 30 in its receiving means 50, may be designed as the second projection optics 31.

Figure 3:
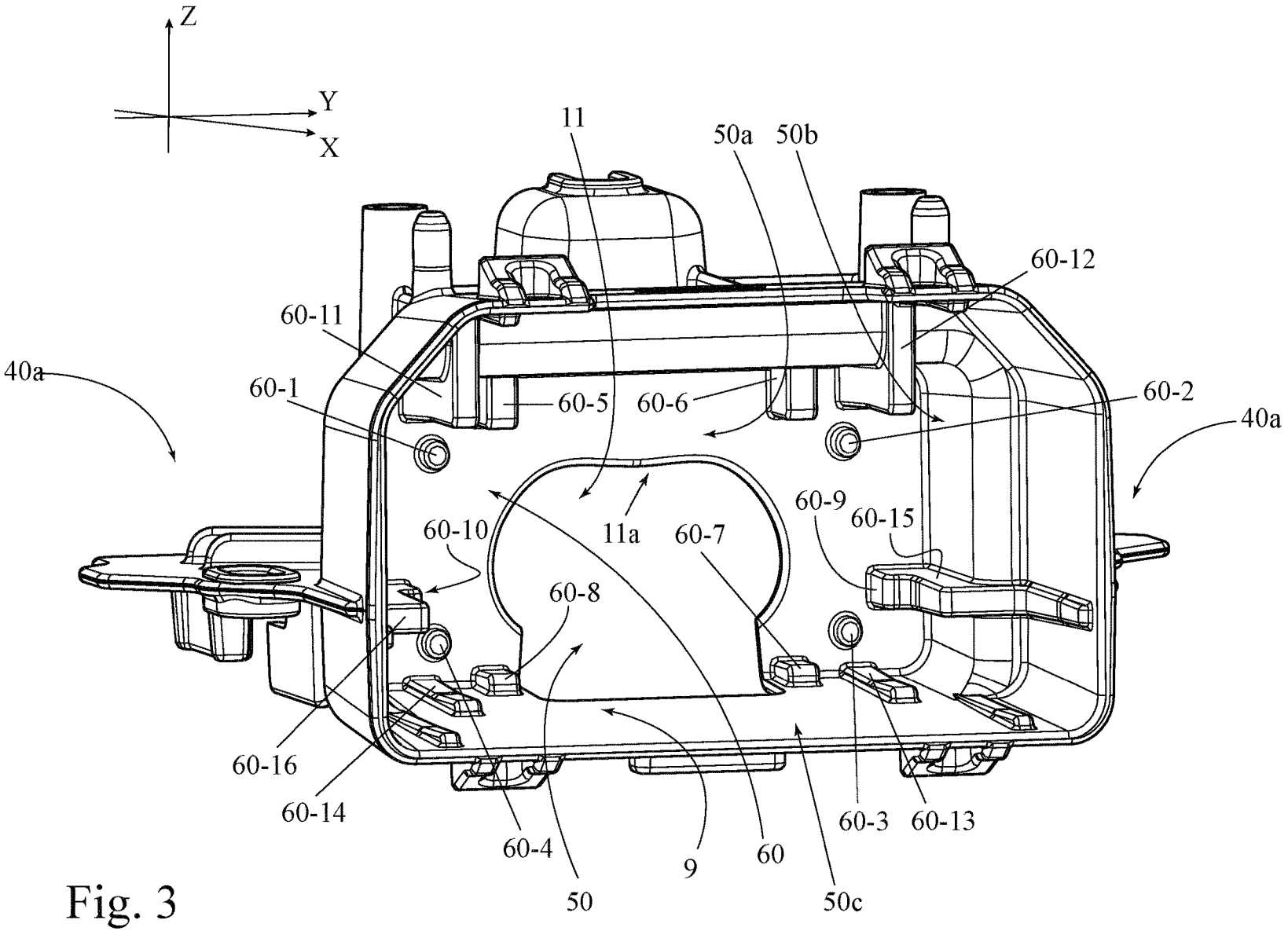
FIG. 3 shows a projection optics holder of the lighting device from FIG. 2.
Figure 4:
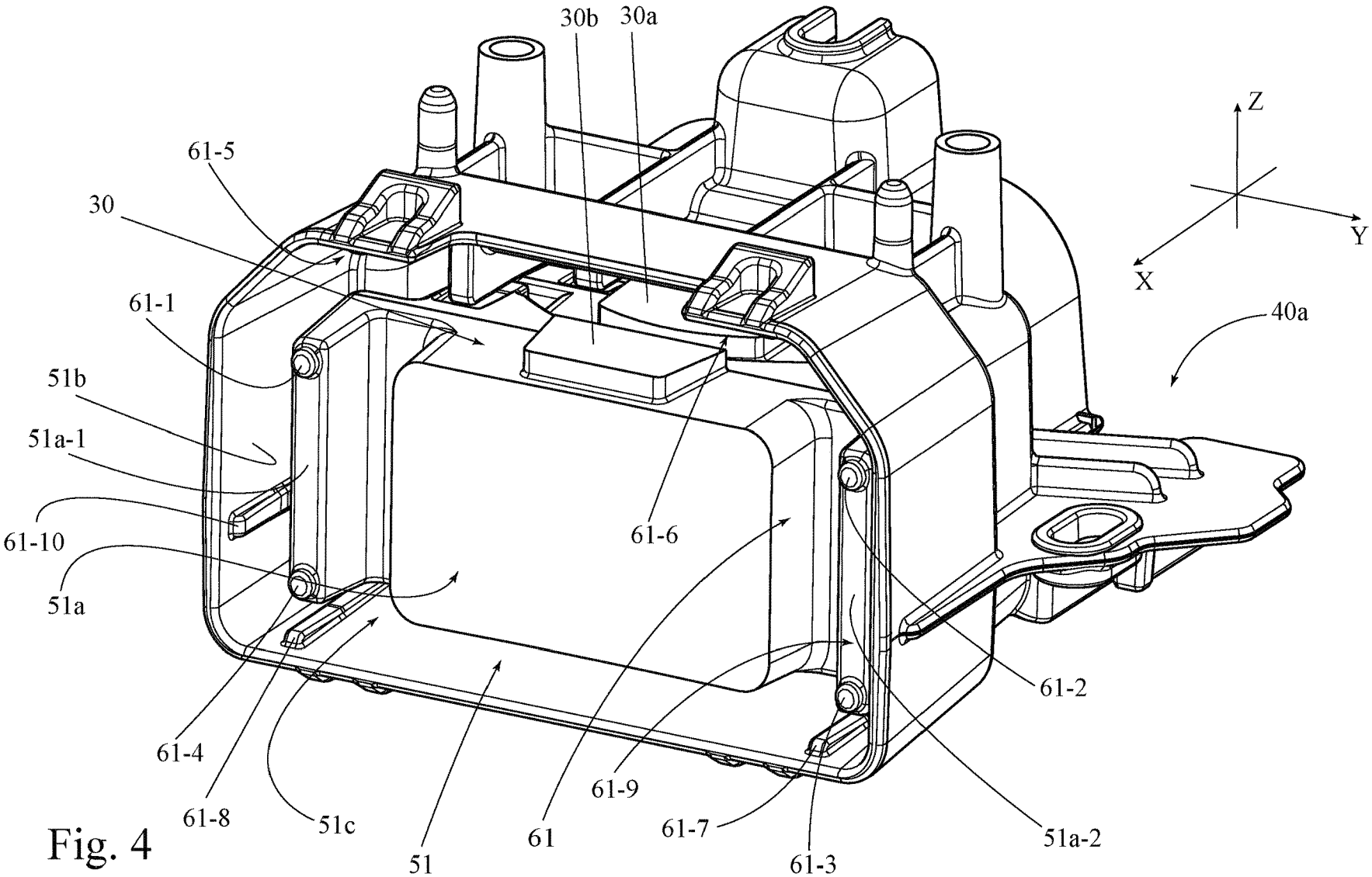
FIG. 4 shows the projection optics holder from FIG. 3 with a first projection optics.

Furthermore, it is indicated in FIGS. 2 to 4 that the projection optics 30, 31 and the receiving means 50, 51 are of different sizes. This means, for example, that the receiving means 50 can be smaller than the receiving means 51 (FIGS. 2 to 4). The size of the receiving means 50, 51 may taper down toward the at least one light source 2. In addition, FIGS. 2 to 4 indicate that the receiving means 50 consists of two partial receiving means, wherein each of the partial receiving means is set up/designed for accommodating a corresponding partial lens 30*a*, 30*b*. In addition, three or four, e.g., additional referencing elements (not shown in the drawings) may be arranged between the partial lenses 30*a*, 30*b*, which elements reference the partial lens 30*b* to the partial lens 30*a* in the X direction. The partial receiving means for the first partial lens 30*a* may be smaller than the partial receiving means for the second partial lens 30*b*.

The two projection optics 30, 31 may be designed in such a way that the lens 10 has an apochromatic effect.

FIGS. 1 to 4 further indicate that each of the receiving means has a receiving means bottom, wherein at least three of the reference points are designed as referencing elements arranged between the corresponding receiving means bottom and the at least one projection optics accommodated in the corresponding receiving means. The referencing elements make contact with both the receiving means bottom and the projection optics and are designed in such a way that they define a primary plane YZ—in the sense of the 3-2-1 rule.

Specifically, FIGS. 2 to 4, e.g., indicate that each of the two receiving means 50, 51 has a receiving means bottom 50*a*, 51*a* (the receiving means 5 in FIG. 1*a* to 1*c* also has a bottom 5*a*). The bottom of the respective receiving means 50, 51 may, for example, be formed either by the upstream projection optics, as is the case with the receiving means 51 in FIGS. 2 and 4, or by the projection optics holder 40, as is the case with the receiving means 50 (see FIG. 3). This applies mutatis mutandis to the partial receiving means described above (cf. FIGS. 2 to 4). At least three of the reference points are designed as referencing elements 60-1 to 60-4, 61-1 to 61-4, which are arranged between the respective receiving means bottom 50*a*, 51*a* and the respective projection optics 30, 31. Both the receiving means bottom 50*a*, 51*a* in question and the corresponding projection optics 30, 31 are contacted by the referencing elements 60-1 to 60-4, 61-1 to 61-4. For example, the second projection optics 31 rests on the referencing elements 61-1 to 61-4, wherein the referencing elements 61-1 to 61-4 are designed on the first projection optics 30. The first projection optics 30, in particular the first partial lens 30*a*, rests on the referencing elements 60-1 to 60-4, which referencing elements are designed on the projection optics holder 40. FIG. 2 shows that these referencing elements 61-1 to 61-4 are designed on the second partial lens 30*b*.

The referencing elements 60-1 to 60-4 and 61-1 to 61-4 each define a different primary plane YZ. The different primary planes are preferably parallel to each other. In addition, it is advantageous if all primary planes YZ are arranged essentially parallel to at least the receiving means bottom 50*a* of the first receiving means 50 (as seen from the light source).

FIGS. 3 and 4 indicate that the referencing elements 60-1 to 60-4 (FIGS. 3) and 61-1 to 61-4 (FIG. 4) may be designed as protrusions extending in the direction of the optical axis X. In addition, FIGS. 3 and 4 indicate that four referencing elements are provided in each receiving means. The fourth referencing element helps prevent, for example, a tilting of the projection optics 30, 31 in the receiving means 50, 51. It is quite conceivable that more referencing elements (five, six or more) are provided.

The referencing elements 60-1 to 60-4 (FIGS. 3) and 61-1 to 61-4 (FIG. 4) shown here have approximately the shape of a hemisphere flattened at its top. Other geometric shapes of the referencing elements are quite conceivable.

The referencing elements 6-1 to 6-3, 60-1 to 60-4, 61-1 to 61-4 can therefore be designed on the projection optics holder 4, 40 and/or on one or more projection optics 3, 30, 31. They can form a monolithic structure with the projection optics holder 4, 40 and/or with at least one projection optics 3, 30, 31. If the referencing elements are designed on the projection optics, it is useful if they are designed on the optically ineffective surfaces of the projection optics.

FIGS. 1 to 4 also indicate that the referencing elements 6-1 to 6-3, 60-1 to 60-4, 61-1 to 61-4 can be designed as spacers.

Furthermore, it is indicated in FIGS. 1 to 4 that the receiving means 5, 50, 51 each have a side wall 5*b*, 50*b*, 51*b*. The side wall 5*b* in FIG. 1*a* to 1*c* is partly formed by the projection optics holder 4 and partly by the closing element 7. The side walls 50*b*, 51*b* in FIGS. 2 to 4 are formed by the projection optics holder 40. At least two more of the reference points, namely those which are not designed as referencing elements, are designed as centring elements 6-4 to 6-6, 60-5 to 60-16 and 61-5 to 61-10, wherein these at least two centring elements 6-4 to 6-6, 60-5 to 60-16 and 61-5 to 61-10 are arranged between an interior circumference of the side wall 5*b*, 50*b*, 51*b* and the projection optics 3, 30, 31 accommodated in the corresponding receiving means 5, 50, 51. The centring elements 6-4 to 6-6, 60-5 to 60-16 and 61-5 to 61-10 make contact with both the side wall 5*b*, 50*b*, 51*b* and the projection optics 3, 30, 31 and restrict the movement of the at least one projection optics 3, 30, 31 along the primary plane YZ.

It should be noted that not all projection optics 3, 30, 31 have to make contact with the corresponding centring elements 6-4 to 6-6, 60-5 to 60-16 and 61-5 to 61-10 when the lens 1, 10 is assembled. This means that some clearance between the projection optics 3, 30, 31 and the receiving means 5, 50, 51 along the primary plane YZ is permissible. However, a situation is conceivable in which there is no such clearance. For example, spring elements (not shown here) may be provided in the projection optics holder 4, 40 to compensate for the clearance. These spring elements may, for example, be designed integrally with the projection optics holder 4, 40 or as separate inserts.

Preferably, the centring elements 6-4 to 6-6, 60-5 to 60-16 and 61-5 to 61-10 are designed on the projection optics holder 4, 40. In the projection optics holder 4 from FIG. 1*a* to 1*c*, two centring elements 6-4 and 6-6 are designed as two ridges, which are designed in an approximately triangular shape in a cross-section located parallel to the YZ plane and are connected in a lower region of the projection optics holder 4 by means of a bar to form a V-shape (as seen from the front). The rotationally symmetrical projection optics 3, for example a lens, can be inserted in this V-shape. The described V-shape is particularly advantageous when using rotationally symmetrical projection optics. Centring elements that together form a V-shape can also be used with projection optics holders accommodating multiple rotationally symmetrical projection optics.

In the projection optics holder 40 shown in FIGS. 2 to 4, the centring elements 60-5 to 60-16 and 61-5 to 61-10 are designed on the interior circumference of the side wall 50*b*, 51*b* of the corresponding receiving means 50, 51, which wall is formed by the projection optics holder 40. Preferably, the centring elements 60-5 to 60-16 and 61-5 to 61-10 form a monolithic structure with the projection optics holder 40.

Specifically, the centring elements 60-5 to 60-16 and 61-5 to 61-10 are designed in the projection optics holder 40 as centring ridges extending in the direction of the optical axis X, preferably flattened at their top.

The longitudinal direction of these ridges is the X-direction—the optical axis of the lens 10. In addition, the centring elements 60-5 to 60-16 and 61-5 to 61-10 protrude from the interior of the projection optics holder 40 toward the centre of the lens 10, preferably perpendicular to the optical axis X.

The at least one projection optics 30, 31 may have counter elements 60-17 to 60-22, 61-11 to 61-13 corresponding to the centring elements 60-5 to 60-16 and 61-5 to 61-10. The counter elements 60-17 to 60-22, 61-11 to 61-13 of all lenses 30*a*, 30*b* and 31 are designed as recesses corresponding to the centring ridges. This is particularly evident in FIG. 2.

The receiving means 5, 50, 51 each have a receiving means opening 5*c*, 50*c*, 51*c*. As already mentioned, each receiving means 5, 50, 51 can be, or is, closed by a closing element 7, 70. The closing element 7 of FIG. 1*a* to 1*c* is designed as a (square-shaped) bracket, which, seen laterally, has approximately the shape of a Greek capital letter gamma and, seen from the front, has a centrally arranged opening, such that light emitted from the projection optics 3 can escape from the lens 1. The shape of bracket 7 can also be different. The closing element 7 is attached to the projection optics holder 4 by locking, screwing, clamping or gluing it to the same, for example.

In the lens 10 from FIGS. 2 to 4, the first receiving means 50 is closed by the second projection optics 31. The second receiving means 51 is closed by means of a fastening clip 70, which has an opening in the middle from which the second projection optics 31 protrudes.

The closing elements 7, 70 are designed in such a way that light can be emitted from the corresponding projection optics 3, 30, 31 and escape from the lens 1, 10.

In reference to FIGS. 2 to 4, it is noteworthy that the fastening clip 70 is attached to the projection optics holder 40 in such a way that it pushes the at least one projection optics 30, 31 accommodated in the projection optics holder 40 at least in a direction opposite to the direction of an optical axis X of the lens 10. As a result, the projection optics 30, 31 are fixed in the projection optics holder 40 in such a way that they can no longer move along the optical axis X—thus determining the focal length of the lens 10. This means that the fastening clip 70 clamps the projection optics 30, 31 in the projection optics holder 40, such that a clearance between the optics 30, 31 in the direction of the optical axis X is no longer possible. In an advantageous embodiment, which is shown in FIG. 2, two protrusions 70*a* are designed on the fastening clip 70, which define a preferably horizontal line which extends perpendicular to the optical axis X. The protrusions 70*a*, or ridges, protrude from the fastening clip 70 in the direction opposite to the direction of the optical axis X. But more than two protrusions 70*a* can also be provided.

In addition, the fastening clip 70 has locking openings 70*b* corresponding to the locking catches 40*b* designed on the projection optics holder 40, such that the fastening clip 70 can lock onto the projection optics holder 40. The locking catches 70*b* are designed on an exterior circumference of the projection optics holder 40.

The lens 10 optionally comprises two, preferably two-dimensional, in particular flat, aperture devices 11 and 12, which are arranged perpendicular to the optical axis X (in the YZ plane). Each aperture device 11, 12 has an aperture edge 11*a*, 12*a* which is continuous within itself. The (first) aperture device 11 is designed integrally with, or constitutes, the receiving means bottom 50*a*. The (second) aperture device is designed as a separate plate 12. Through-openings 12*d* are provided in the plate, which match the referencing elements 9-1 to 9-4 designed as ridges. In the assembled state of the lens 10, the ridges 9-1 to 9-4 are accommodated in the through-openings 12*d*. This specifies the position of the plate 12 in the lens 10 relative to the projection optics30, 31. Furthermore, both or only one of the aperture devices 11, 12 may have one or more (preferably two) spring tab(s) 12*b*, 12*c*. FIG. 2 shows that only the plate 12 has the spring tabs 12*b*, 12*c* (two in this example). Due to the spring tabs, e.g., 12*b*, 12*c*, the projection optics 30, 31 are clamped more securely in the corresponding receiving means 50, 51 and the clearance of the projection optics 30, 31 in the YZ plane is reduced. Two spring tabs also reduce the likelihood of tilting. The two tabs 12*b*, 12*c* are preferably arranged to the side of the aperture edge 12*a* which is continuous in itself.

Figure 5:
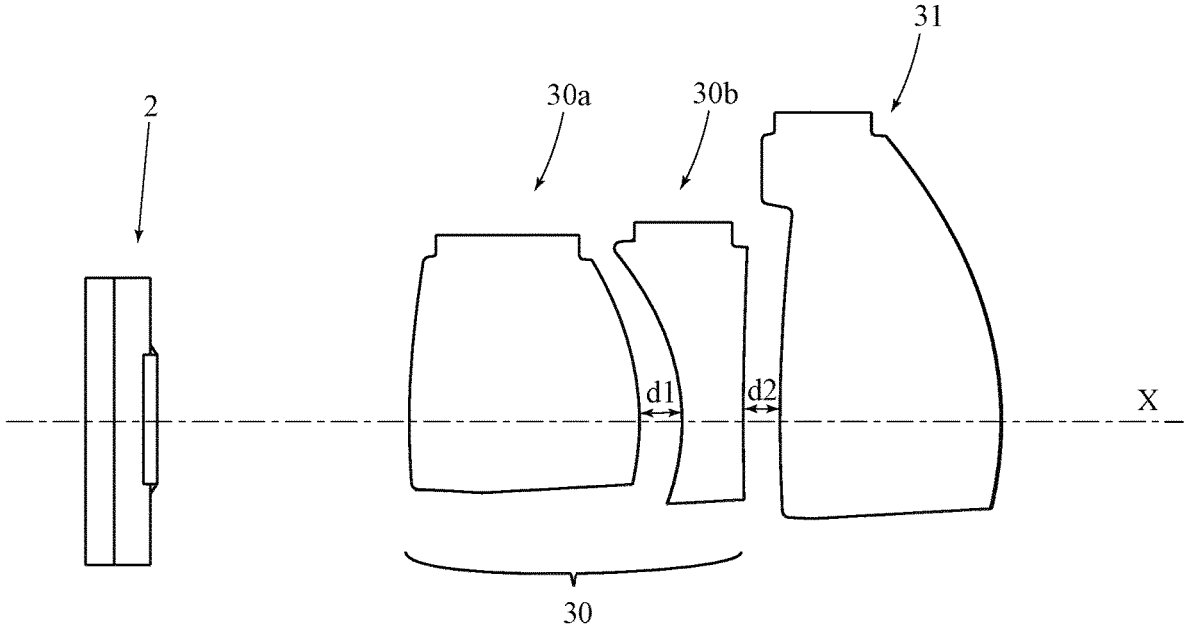
FIG. 5 is a sectional representation of the lens system of the lighting device from FIG. 2.

As already described, the first projection optics 30 from FIGS. 2 to 4 consists of two partial lenses 30*a*, 30*b*. FIG. 5 shows a section of the lens system from FIG. 2 with an XZ plane, i.e., with a plane which defines the optical axis X and the vertical direction Z. The partial lenses 30*a* and 30*b* together are set up to at least correct longitudinal chromatic aberrations; i.e., they have an achromatic effect. The projection optics 30 is therefore a so-called air-spaced achromate (see description of the prior art from DE 10 2010 046 626 84 and in particular paragraphs [0009] to) [0013]. An air-spaced achromat has the advantage that multiple parameters are present which enable a more accurate correction of the longitudinal chromatic aberration. These parameters are, for example, the size of the air gap d1, curvatures of the entry and light-emitting surfaces of the partial lenses 30*a*, 30*b*, as well as the material of which the partial lenses 30*a*, 30*b* are made. A three-lens element system has the advantage that the distances d1, d2 can be varied to reduce longitudinal and/or lateral chromatic aberrations for further improving the quality of the light distribution generated by the lighting device.

The lighting device described above can be used with advantage in a motor vehicle headlight.

The object of the above description merely is to provide illustrative examples and to indicate further advantages and peculiarities of the present invention. The above description cannot therefore be interpreted as a restriction of the field of application of the invention or the patent rights claimed in the claims. In the above detailed description, for example, various features of the invention are summarized in one or more embodiments for the purpose of streamlining the disclosure. This type of disclosure is not to be understood as reflecting the intention that the claimed invention requires more features than those expressly mentioned in each claim. Rather, as the following claims reflect, inventive aspects are present in fewer than all features of a single embodiment described above. (Thus, the following claims are hereby included in this detailed description, with each claim alone representing a separate preferred embodiment of the invention.)

In addition, although the description of the invention contains the description of one or more embodiments and certain variations and modifications, other variations and modifications, for example those within the skills and knowledge of persons skilled in the art, are within the scope of the invention according to the understanding of the present disclosure.

The reference numbers in the claims merely serve for a better understanding of the present invention and in no way constitute a limitation of the present invention.

The invention claimed is:

1. A lighting device of a motor vehicle headlamp, comprising:

a lens (1, 10) which has at least one projection optics (3, 30, 31) and one projection optics holder (4, 40); and at least one light source (2), which is configured to generate a lighting pattern (LI), wherein the lighting pattern (LI) generated by the light source (2) can be projected in front of the lighting device in the form of a light distribution by means of the lens (1, 10), wherein:

at least one receiving means (5, 50, 51) is designed in the projection optics holder (4, 40), the at least one receiving means (5, 50, 51) corresponds to the at least one projection optics (3, 30, 31), the at least one projection optics (3, 30, 31) is accommodated in the at least one receiving means (5, 50, 51), a reference point system (6, 60, 61) is defined in the at least one receiving means (5, 50, 51) for determining a position of the projection optics (3, 30, 31) accommodated in this receiving means (5, 50, 51) in such a way that the lighting pattern (LI) is essentially located in a focal plane of the lens (1, 10), reference points (6-1 to 6-6, 60-1 to 60-16, 61-1 to 61-10) of the reference point system (6, 60, 61) are arranged according to the 3-2-1 rule, and the at least one receiving means (5, 50, 51) is closed by means of a closing element (7, 70) in such a way that the at least one projection optics (3, 30, 31) is fixed and held in the at least one receiving means (5, 50, 51) in the position determined by the reference point system (6, 60, 61), and each receiving means (5, 50, 51) is closed by means of one closing element (7, 70) each, wherein at least one of the closing elements (7, 70) is designed as one of the at least two projection optics (3, 30, 31).

2. The lighting device according to claim 1, wherein the lens (1, 10) comprises at least two projection optics (3, 30, 31) and at least two receiving means (5, 50, 51) are designed in the projection optics holder (4, 40), wherein each receiving means (5, 50, 51) corresponds to a projection optics (3, 30, 31) and different receiving means (5, 50, 51) correspond to different projection optics (3, 30, 31), wherein:

each projection optics (3, 30, 31) is accommodated in a receiving means (5, 50, 51) corresponding to the projection optics (3, 30, 31) and different projection optics (3, 30, 31) are accommodated in different receiving means (5, 50, 51), a reference point system (6, 60, 61) is defined in each receiving means (5, 50, 51) for determining the position of the projection optics (3, 30, 31) accommodated in this receiving means (5, 50, 51), reference points (6-1 to 6-6, 60-1 to 60-16, 61-1 to 61-10) of each reference point system (6, 60, 61) are arranged according to the 3-2-1 rule, and the reference points (6-1 to 6-6, 60-1 to 60-16, 61-1 to 61-10) of the different reference point systems (6, 60, 61) are designed in such a way that all defined positions of the projection optics (3, 30, 31) are coordinated with each other in such a way that optical axes of the different projection optics (3, 30, 31) coincide and that the lighting pattern (LI) is located in the focal plane of the lens (1, 10).

3. The lighting device according to claim 1, wherein the reference points (6-1 to 6-6, 60-1 to 60-16, 61-1 to 61-10) of the reference point system (6, 60, 61) are arranged according to the area principle or translation-rotation-constraint principle of the 3-2-1 rule.

4. The lighting device according to claim 1, wherein the at least one receiving means (5, 50, 51) has a receiving means bottom (5*a*, 50*a*, 51*a*), at least three of the reference points (6-1 to 6-6, 60-1 to 60-16, 61-1 to 61-10) are designed as referencing elements (6-1 to 6-3, 60-1 to 60-4, 61-1 to 61-4), wherein the at least three referencing elements (6-1 to 6-3, 60-1 to 60-4, 61-1 to 61-4) are arranged between the receiving means bottom (5*a*, 50*a*, 51*a*) and the at least one projection optics (3, 30, 31), make contact with both the receiving means bottom (5*a*, 50*a*, 51*a*) and the projection optics (3, 30, 31) and define a primary plane (YZ) of the reference point system (6, 60, 61).

5. The lighting device according to claim 4, wherein the at least one receiving means (5, 50, 51) has a side wall (5*b*, 50*b*, 51*b*), wherein at least two more of the reference points (6-1 to 6-6, 60-1 to 60-16, 61-1 to 61-10) are designed as centring elements (6-4 to 6-6, 60-5 to 60-16 and 61-5 to 61-10), wherein the at least two centring elements (6-4 to 6-6, 60-5 to 60-16 and 61-5 to 61-10) are arranged between an interior circumference of the side wall (5*b*, 50*b*, 51*b*) and the at least one projection optics (3, 30, 31), make contact with both the side wall (5*b*, 50*b*, 51*b*) and the projection optics (3, 30, 31) and restrict the movement of at least one projection optics (3, 30, 31) along the primary plane (YZ).

6. The lighting device according to claim 4, wherein the primary plane (YZ) of the reference point system (6, 60, 61) is arranged essentially parallel to the receiving means bottom (5*a*, 50*a*, 51*a*).

7. The lighting device according to claim 1, wherein the at least one receiving means (5, 50, 51) has a receiving means opening (5*c*, 50*c*, 51*c*), wherein the closing element (7, 70) closing the at least one receiving means (5, 50, 51) is designed in the receiving means opening (5*c*, 50*c*, 51*c*) in such a way that the light emitted from the at least one projection optics (3, 30, 31) can pass through the closing element (7, 70).

8. The lighting device according to claim 1, wherein the closing element is designed as a fastening clip (70).

9. The lighting device according to claim 8, wherein the fastening clip (70) is attached to the projection optics holder (4, 40) in such a way that it pushes the at least one projection optics (3, 30, 31) accommodated in the projection optics holder (4, 40) at least in a direction opposite to the direction of an optical axis (X) of the lens (1, 10).

10. The lighting device according to claim 8, wherein the fastening clip is connected to the projection optics holder (4, 40) by means of a locking connection.

11. The lighting device according to claim 1, wherein the at least one light source (2) comprises a spatial light modulator, in particular a DMD chip, and generates the lighting pattern (LI) on the spatial light modulator.

12. The lighting device according to claim 1, wherein the lens (1, 10) further comprises at least one aperture device (11, 12).

13. The lighting device according to claim 1, wherein the at least one projection optics (3, 30, 31) consists of two partial lenses (30*a*, 30*b*).

14. The lighting device according to claim 1, wherein the lens (1, 10) comprises elastic elements which are configured to clamp the at least one projection optics (3, 30, 31) in the at least one receiving means (5, 50, 51).

15. The lighting device according to claim 11, wherein the mirror array of the spatial light modulator is located in a focal plane of the lens (1, 10).

16. The lighting device according to claim 12, wherein the at least one aperture device (11, 12) is a flat aperture device.

17. The lighting device according to claim 13, wherein the at least one projection optics (3, 30, 31) has an achromatic effect.

18. The lighting device according to claim 14, wherein the elastic elements are arranged in the projection optics holder (4, 40).

19. A motor vehicle headlight having at least one of the lighting device according to-claim 1.

* * * * *